United States Patent [19]

Nakamura

[11] Patent Number: 4,690,379

[45] Date of Patent: Sep. 1, 1987

[54] ELECTRIC CHAIN BLOCK

[75] Inventor: Takayoshi Nakamura, Nakakoma, Japan

[73] Assignee: Kabushiki Kaisha Kito, Yamanashi, Japan

[21] Appl. No.: 832,788

[22] Filed: Feb. 26, 1986

[30] Foreign Application Priority Data

Feb. 27, 1985 [JP] Japan ..... 60-36500

[51] Int. Cl.[4] ..... B66D 3/20; B66D 5/22

[52] U.S. Cl. ..... 254/347; 254/903; 192/8 R

[58] Field of Search ..... 254/347, 350, 366, 365, 254/900; 192/8 A, 8 R, 56 R; 464/36, 38, 46; 188/82.3, 82.34

[56] References Cited

U.S. PATENT DOCUMENTS

| | | | |
|---|---|---|---|
| 2,501,096 | 3/1950 | Robins et al/ | 254/903 X |
| 3,047,114 | 7/1962 | Stevens | 254/350 X |
| 3,399,867 | 9/1968 | Schroeder | 254/903 X |
| 3,727,887 | 4/1973 | Lytle | 254/903 X |
| 3,756,359 | 9/1973 | Suez | 254/347 X |
| 4,348,011 | 9/1982 | Honda | 254/350 |
| 4,508,318 | 4/1985 | Maeda | 254/903 X |
| 4,605,111 | 8/1986 | Ohno | 254/346 X |

FOREIGN PATENT DOCUMENTS 146922 9/1982 Japan .

*Primary Examiner*—Stuart S. Levy
*Assistant Examiner*—Katherine Matecki
*Attorney, Agent, or Firm*—Sughrue, Mion, Zinn, Macpeak & Seas

[57] ABSTRACT

An electric chain block includes a driving shaft connected to a rotating shaft of an electric motor, and a driving gear provided on the driving shaft, and further includes an intermediate driven gear in mesh with the driving gear, a torque limiter and a mechanical brake assembly between the driving shaft and a load sheave. The electric chain block comprises an intermediate shaft arranged in parallel with said driving shaft, a support member anchored to the intermediate shaft, an urging member fitted on the intermediate shaft, a cam support provided inside the intermediate driven gear and fitted on the intermediate shaft between the support member and the urging member, a retainer disc and a brake receiving disc axially slidably but nonrotatably on said intermediate shaft respectively on one side and the other side of the cam support, at least one of these members being a spring, a ratchet wheel for braking interposed between the intermediate driven gear and the brake receiving disc and engaging a pawl for braking, brake releasing cam members accommodated in cam grooves formed in a side of the cam support, depths of the cam grooves changing circumferentially of the intermediate shaft, and an adjusting nut threadedly engaging an extending end of the intermediate shaft for adjusting urging force of the urging member.

7 Claims, 7 Drawing Figures

ELECTRIC CHAIN BLOCK

BACKGROUND OF THE INVENTION

This invention relates to an electric chain block having a torque limiter and a mechanical brake in a reduction gear assembly.

An electric chain block having a torque limiter and a mechanical brake is known as disclosed Japanese Patent Application Publication No. 38,378/79. In such an electric chain block, a driving shaft connected to a rotating shaft of an electric motor is integrally formed with a driving gear, and a hollow driven shaft having a load sheave thereon is rotatably fitted on the driving shaft. Moreover, a torque limiter having an annular driven gear and a mechanical brake are arranged in series side by side on the hollow driven shaft. An intermediate driven shaft is located in parallel with the driving shaft and is provided thereon with an intermediate driven gear and an intermediate drive gear which are in mesh with the driving gear and the annular driven gear, respectively.

With this electric chain block, however, the torque limiter cannot be adjusted to change its transmitting torque from outside of the chain block after it has been assembled. Moreover, this chain block has a disadvantage of an unduly long driving shaft which makes the chain block bulky.

Moreover, an electric chain block including a reduction gear assembly having a torque limiter and a mechanical brake has been disclosed in Japanese Patent Application Publication No. 42,937/78. With this chain block, an intermediate shaft and a brake restraining member must be worked to from screw threads with high accuracy. This in turn increases the cost of manufacturing. Similar to the first mentioned prior art, moveover, transmission torque of the torque limiter cannot be adjusted from outside of a gear box after assembling.

SUMMARY OF THE INVENTION

It is a principal object of the invention to provide an electric chain block which effectively solves the above problems in the prior art.

In order to achieve this object, an electric chain block including a driving shaft connected to a rotating shaft of an electric motor, and a driving gear provided on the driving shaft, and further including an intermediate driven gear in mesh with said driving gear, a torque limiter and a mechanical brake assembly between the driving shaft and a load sheave according to the invention comprises an intermediate shaft arranged in parallel with said driving shaft, a support member anchored to the intermediate shaft, an urging member fitted on the intermediate shaft, a cam support provided inside said intermediate driven gear and fitted on said intermediate shaft between said support member and said urging member, a retainer disc and a brake receiving disc axially slidably but nonrotatably on said intermediate shaft respectively on one side and the other side of the cam support, at least one of said support member and said urging member being a spring, a ratchet wheel for braking interposed between the intermediate driven gear and the brake receiving disc and engaging a pawl for braking, brake releasing cam members accommodated in cam grooves formed in a side of said cam support, depths of said cam grooves changing circumferentially of the intermediate shaft, and an adjusting nut threadedly engaging an extending end of said intermediate shaft for adjusting urging force of said urging member.

In one embodiment of the invention, the cam support is formed integrally with the intermediate driven gear. The load sheave may be formed integrally with the intermediate shaft.

The invention will be more understood by referring to the following detailed specification and claims taken in connection with the appended drawings.

DESCRIPTION OF THE PREFERRED EMBODIMENTS

Figure 1:
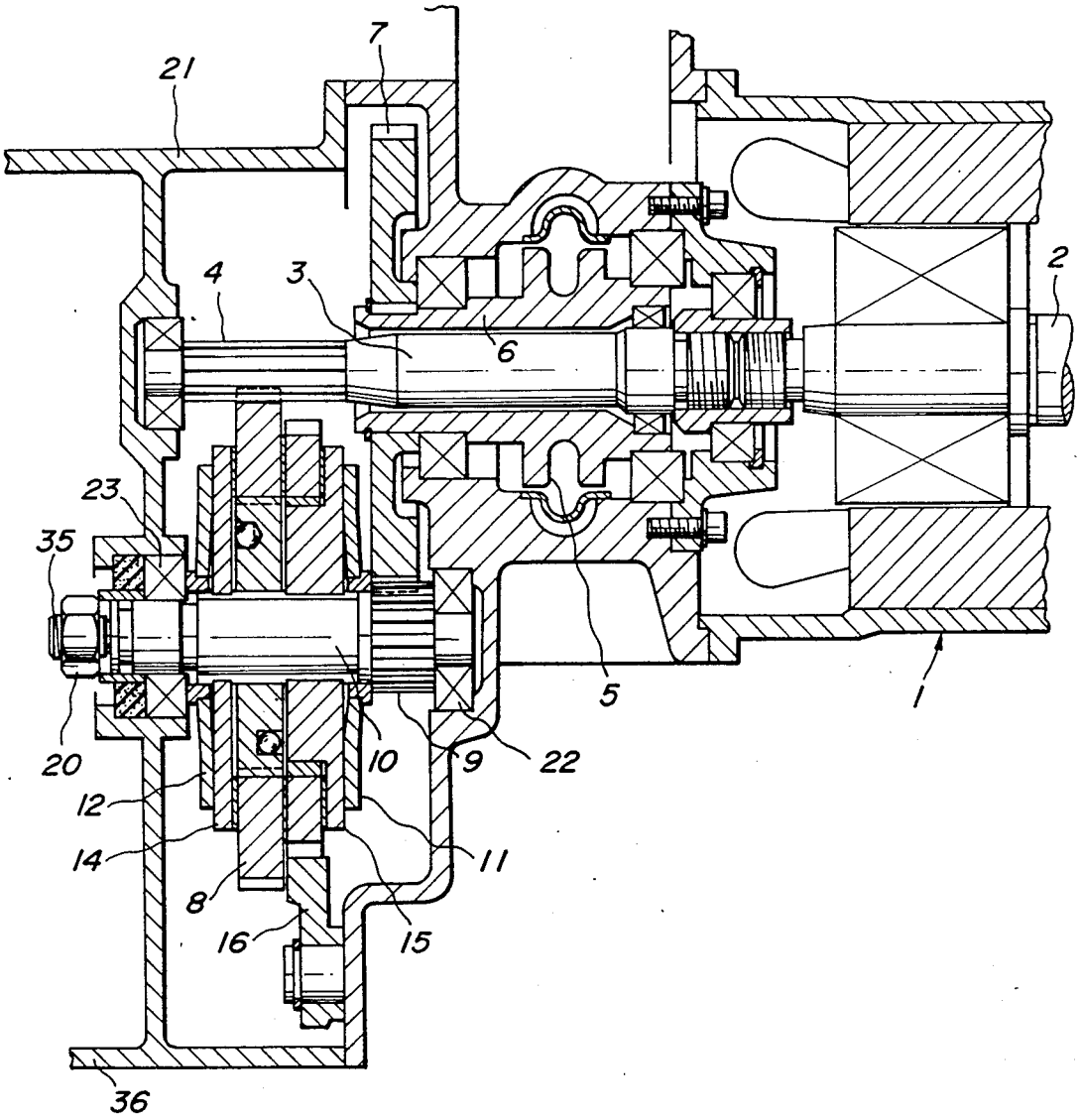
FIG. 1 is a sectional view of an electric chain block of a first embodiment of the invention.
Figure 2:
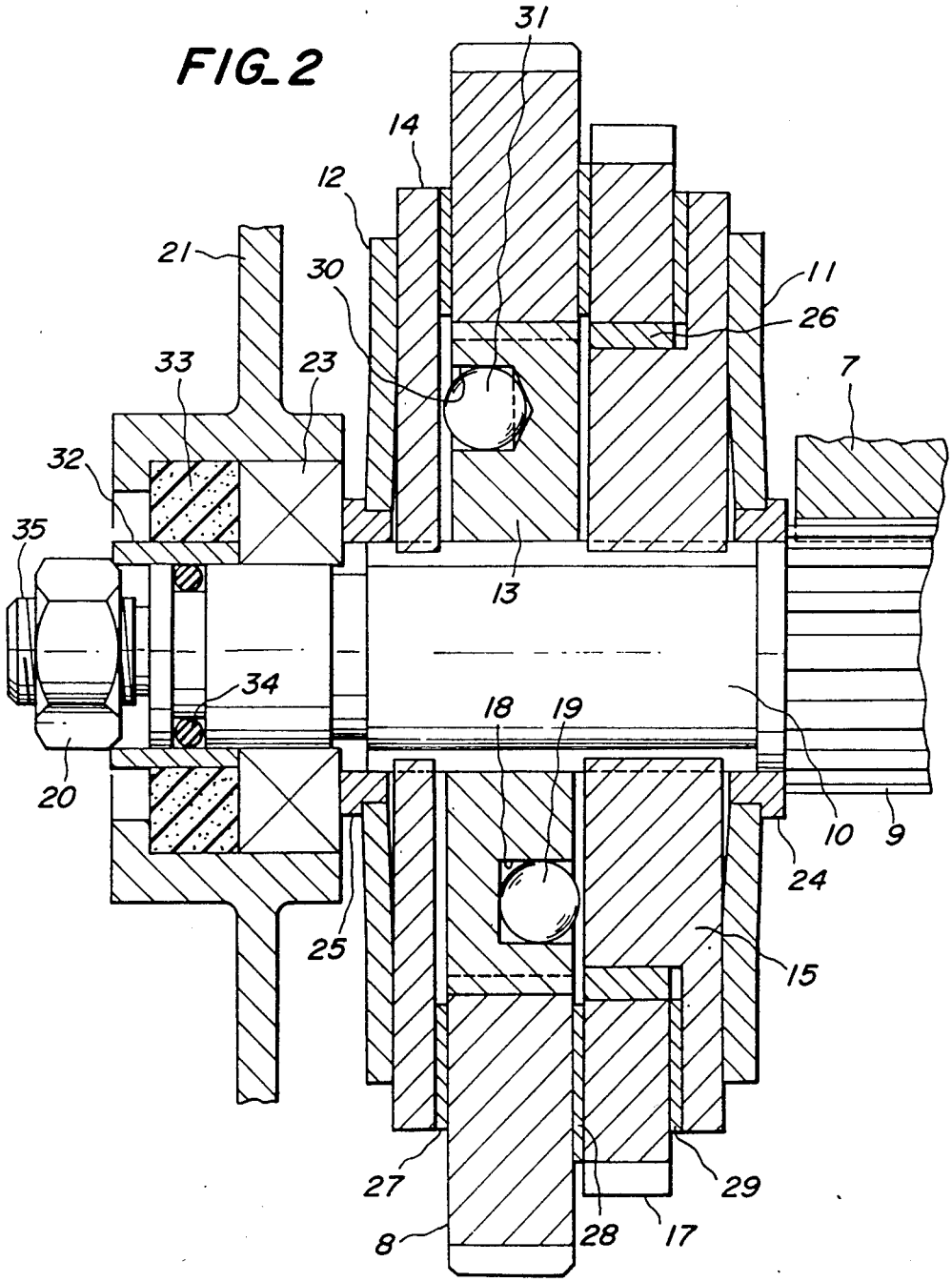
FIG. 2 is an enlarged sectional view of the chain block shown in FIG. 1 illustrating an intermediate gear transmission mechanism having a torque limiter.

FIGS. 1–5 illustrate a first embodiment of the invention. One end of a driving shaft 3 is connected through a coupling to a rotating shaft 2 of an electric motor 1. The other end of the driving shaft 3 is journaled by a bearing in a gear box 21 and is formed with a driving gear 4 having a small diameter. A hollow driven shaft 6 is rotatably fitted on the driving shaft 3 between the driving gear 4 and the coupling, and is integrally formed with a load sheave 5 for winding a load chain (not shown) thereabout. Furthermore, a driven gear 7 having a large diameter is fixed to an end of the hollow driven shaft on the side of the driving gear 4.

An intermediate shaft 10 made of steel is journaled by bearings 22 and 23 in the gear box 21 in parallel with the driving gear 4 of the driving shaft 3. The intermediate shaft 10 is formed at its one end with an intermediate pinion 9 adapted to be in mesh with the driven gear 7. A support ring 24 (FIG. 2) made of a steel is fitted on the intermediate shaft 10 so as to engage one end of the inermediate driving gear 9 and is further fitted on a center hole of a support member 11 in the form of a dish-shaped spring made of a spring steel. Moreover, an urging ring 25 made of a steel is fitted on the other end of the intermediate shaft 10 so as to engage the bearing 23 and further fitted in a center hole of an urging member 12 in the form of a dish-shaped spring made of a sping steel.

A cam support 13 made of steel is rotatably and axially slidably fitted on a mid-portion of the intermediate shaft 10 between the support member 11 and the urging member 12. A retainer disc 14 made of steel heated between the cam support 13 and the urging member 12 is fitted on the intermediate shaft 10 axially slidably but nonrotatably relative thereto. A brake receiving disc 15 positioned between the cam support 13 and the support member 11 is also fitted on the intermediate shaft 10 axially slidably but nonrotatably relative thereto. A ratchet wheel 17 for braking is rotatably fitted on a boss of the brake receiving disc 15 through a sleeve bearing 26. A pawl 16 for braking (FIG. 1) is pivotally mounted on the gear box and is urged into engagement with the ratchet wheel 17 by means of a spring (not shown).

Figure 3:
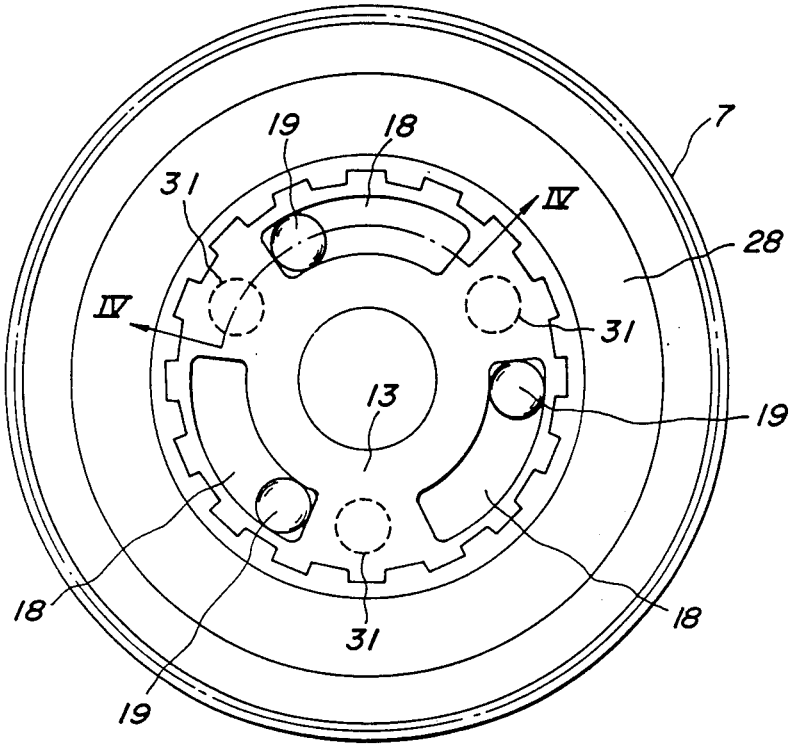
FIG. 3 is a front elevation illustrating spherical bodies and cam support provided in an intermediate driven gear of the chain block shown in FIG. 1.

An intermediate driven gear 8 is fitted on an outer circumference of the cam support 13 axially slidably but against rotation relative thereto. Friction plates 27 and 28 are fixed to side surfaces of the intermediate driven gear 8, respectively, by means of welding, adhesive or the like. A friction plate 29 (FIG. 2) between the ratchet wheel 17 and a flange of the brake receiving disc 15 is fixed to a side surface of the ratchet wheel 17 by means of adhesive. The cam support 13 is formed on a side of the brake receiving disc 15 with a plurality of cam grooves 18 in the form of arcs circumferentially spaced apart from each other and concentric to the intermediate shaft 10. This is shown in FIG. 3. Each the cam groove 18 has a sloped bottom to change the depth of the groove and receives a brake releasing cam member 19 in the form of a steel ball in this embodiment. Moreover, the cam support 13 is formed on a side of the retainer disc 14 with a plurality of recesses 30 circumferentially spaced apart from each other in a circle concentric to the intermediate shaft 10 for receiving steel balls 31.

An urging collar 32 made of steel is fitted on the other end of the intermediate shaft 10 and has one end adapted to engage the bearing 23. An oil sealing ring 33 is arranged between the collar 32 and a wall of the gear box 21 accommodating the bearing 23. An O-ring 34 is fitted in an annular groove formed in the intermediate shaft 10 inside the collar 32. An external screw-thread portion 35 provided on the other end of the intermediate shaft 10 extends outwardly from the gear box 21. An adjusting nut 20 is threadedly engaged wih the external screw-thread portion 35 of the intermediate shaft 10 out of the gear-box 21 and at the same time engages the other end of the collar 32. A tightening force of the adjusting nut 20 urges the central portion of the urging member 12 through the collar 32, the bearing 23 and the urging ring 25 to clamp the retainer disc 14, the intermediate driven gear 8, the ratchet wheel 17, the flange of the brake receiving disc 15 and the friction plates 27, 28 and 29 interposed therebetween with the aid of the support member 11 and the urging member 12.

In this embodiment, a torque limiter is constructed by the urging member 12 and the support member 11 and the intermediate driven gear 8, the retainer disc 14, the brake receiving disc 15, the ratchet wheel 17, and the friction plates 27, 28 and 29 between the members 12 and 11. Moreover, a mechanical brake assembly for preventing the load from dropping is formed by the ratchet wheel 17 held through the retainer disc 14, the brake receiving disc 15, the intermediate driven gear 8 and the friction plates by the spring forces of the support member 11 and the urging member 12; the pawl 16 adapted to engage the ratchet wheel 17; the cam support 13 having cam grooves 18; and the brake releasing cam members 19.

In order to adjust the transmission torque of the torque limiter after the electric chain block has been assembled, such an adjustment is performed by simply rotating the adjusting nut 20 out of the gear-box after an electric equipment receiving cover (not shown) has been removed without requiring disassembling of the electric chain block.

The operation of the electric chain block of the above embodiment will now be explained.

Figure 4:
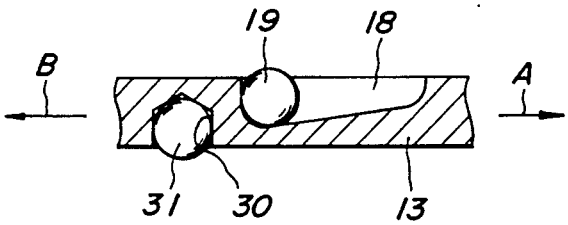
FIG. 4 is a sectional view taken along lines IV—IV in FIG. 3.

When the driving shaft 3 is rotated in a winding-up direction by means of an electric motor 1, the cam support 13 is rotated through the driving gear 4 and the intermediate driven gear 8 in a direction shown by an arrow A in FIG. 4. The brake releasing cam members 19 are therefore located at deeper positions in the cam grooves 18, so that the intermediate driven gear 8, the retainer disc 14, the ratchet wheel 17, the brake receiving disc 15 and the friction plates 27, 28 and 29 are clamped by the preset clamping force. Accordingly, the rotation of the intermediate driven gear 8 is transmitted through the retainer disc 14 and the brake receiving disc 15 to the intermediate shaft 10 and then through the intermediate driving gear 9, the driven gear 7 and the intermediate driven shaft 6 to the load sheave 5, thereby effecting the winding-up operation within the torque set by the torque limiter.

Figure 5:
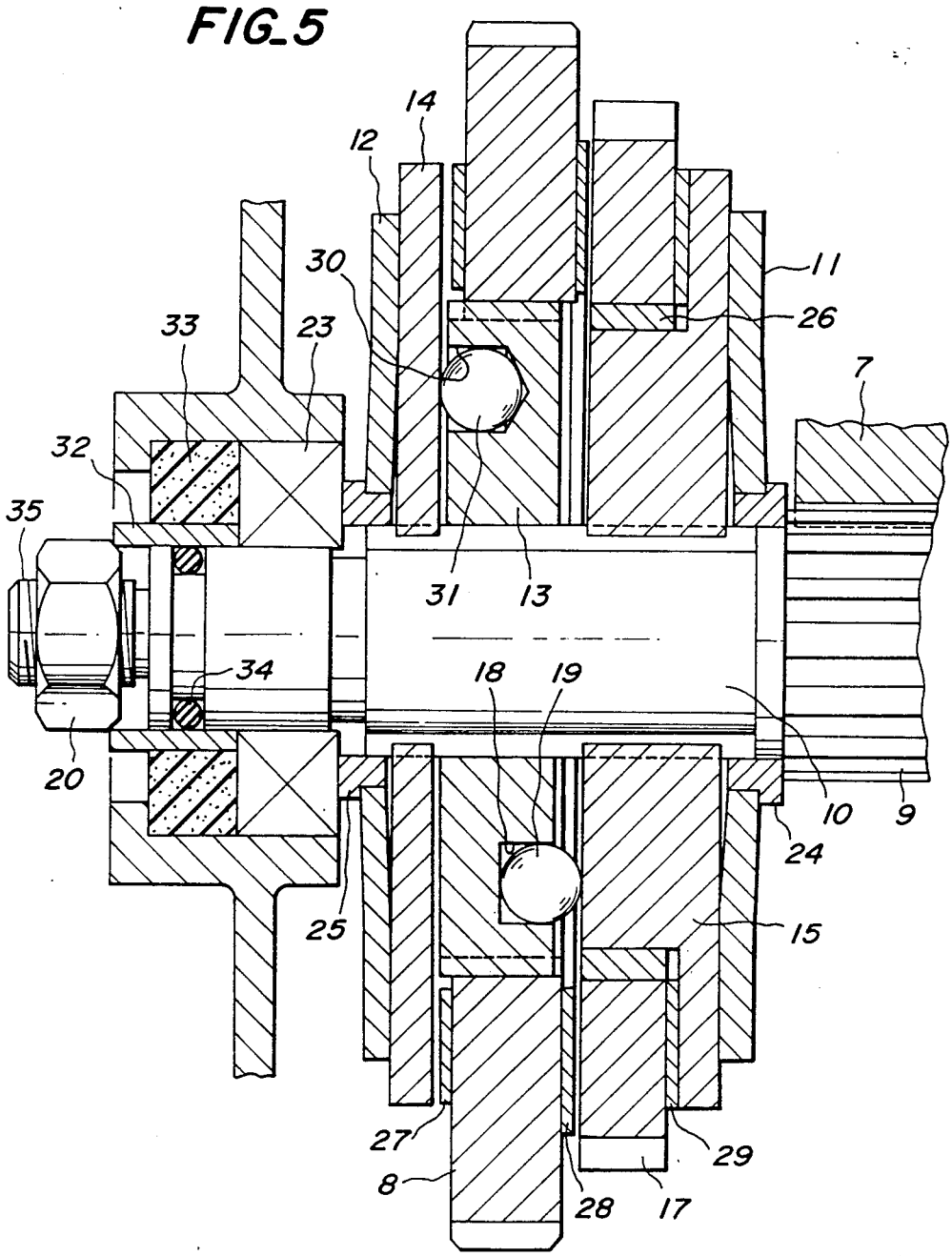
FIG. 5 is a sectional view illustrating a torque limiter in winding-off operation.

When the driving shaft 3 is rotated in a winding-off direction by means of an electric motor 1, the cam support 13 is rotated a reverse direction, i.e. in the direction shown by an arrow B in FIG. 4. Accordingly the brake releasing cam members 19 are moved into shallower positions in the cam grooves 18 so as to extend higher from the side surface of the cam support 13, so that the cam support 13 and the brake receiving disc 15 move away from each other by the extending action of the brake releasing cam members 19 as shown in FIG. 5. As the result, the mechanical brake assembly is released so that the intermediate driving gear 9 is rotated through the load sheave 5 and the driven gear 7 by a weight of the load faster than the rotating speed driven by the motor 1. However, such rotation of the intermediate driving gear 9 results in clamping of the mechanical brake assembly, so that the winding-off operation is performed at a speed substantially equal to or near the speed driven by the motor by the repetition of the releasing and clamping of the brake assembly.

When the electric motor 1 is deenergized after the load is raised or lowered to a desired height, the transmission mechanism of the block tends to rotate in a reverse direction by the weight of the load. However, such a rotation will clamp the mechanical brake assembly into a unitary body, and after the brake assembly has been clamped, further rotation will be prevented by the pawl 16 and the ratchet wheel 17.

Figure 6:
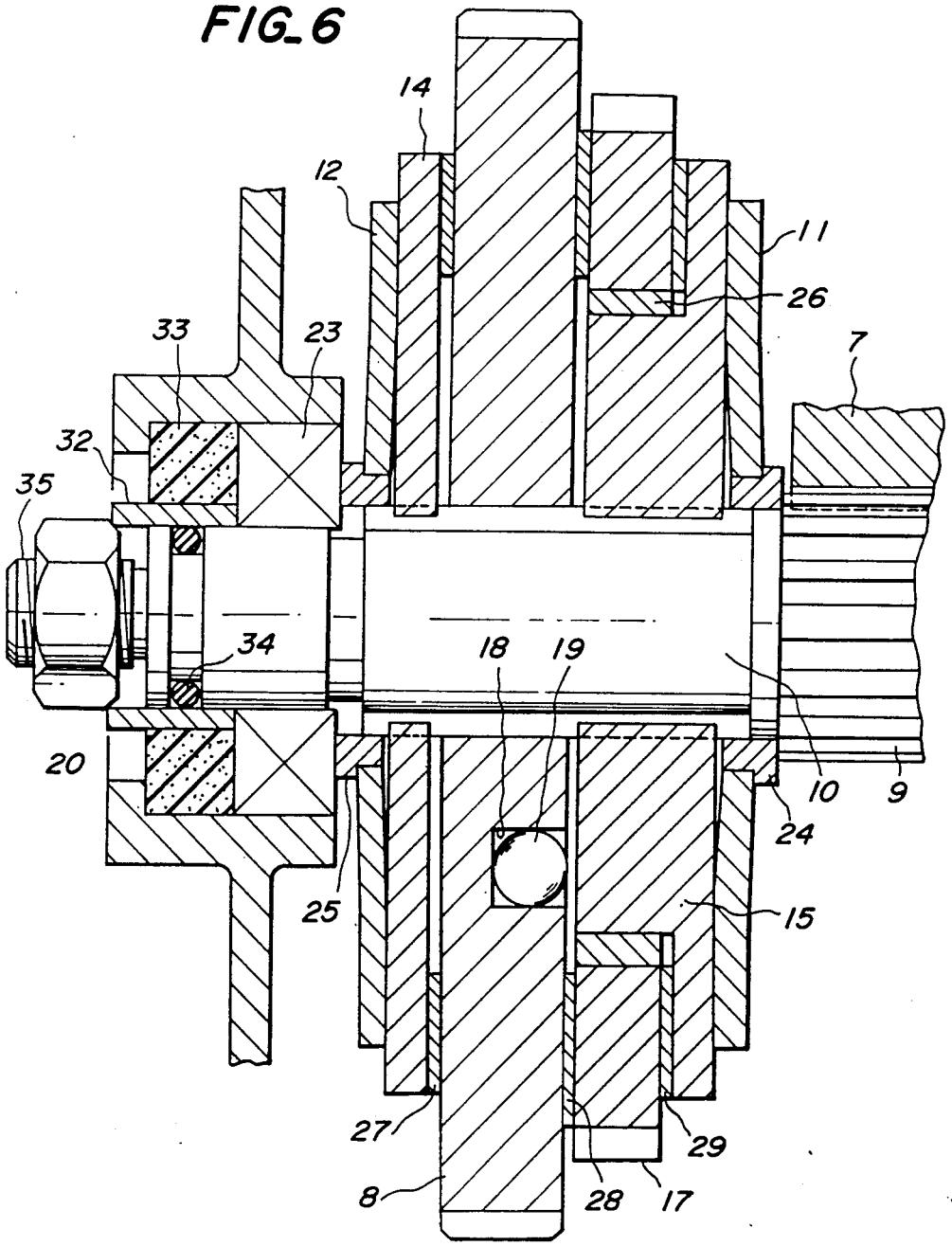
FIG. 6 is a sectional view of an intermediate gear transmission mechanism having a torque limiter used in an electric chain block of a second embodiment of the invention.

FIG. 6 illustrates a second embodiment of the invention. This chain block is substantially identical with that of the first embodiment with exception that a cam support 13 is formed integrally with an intermediate driven gear 8 and does not have recesses 30 and steel balls 31.

Figure 7:
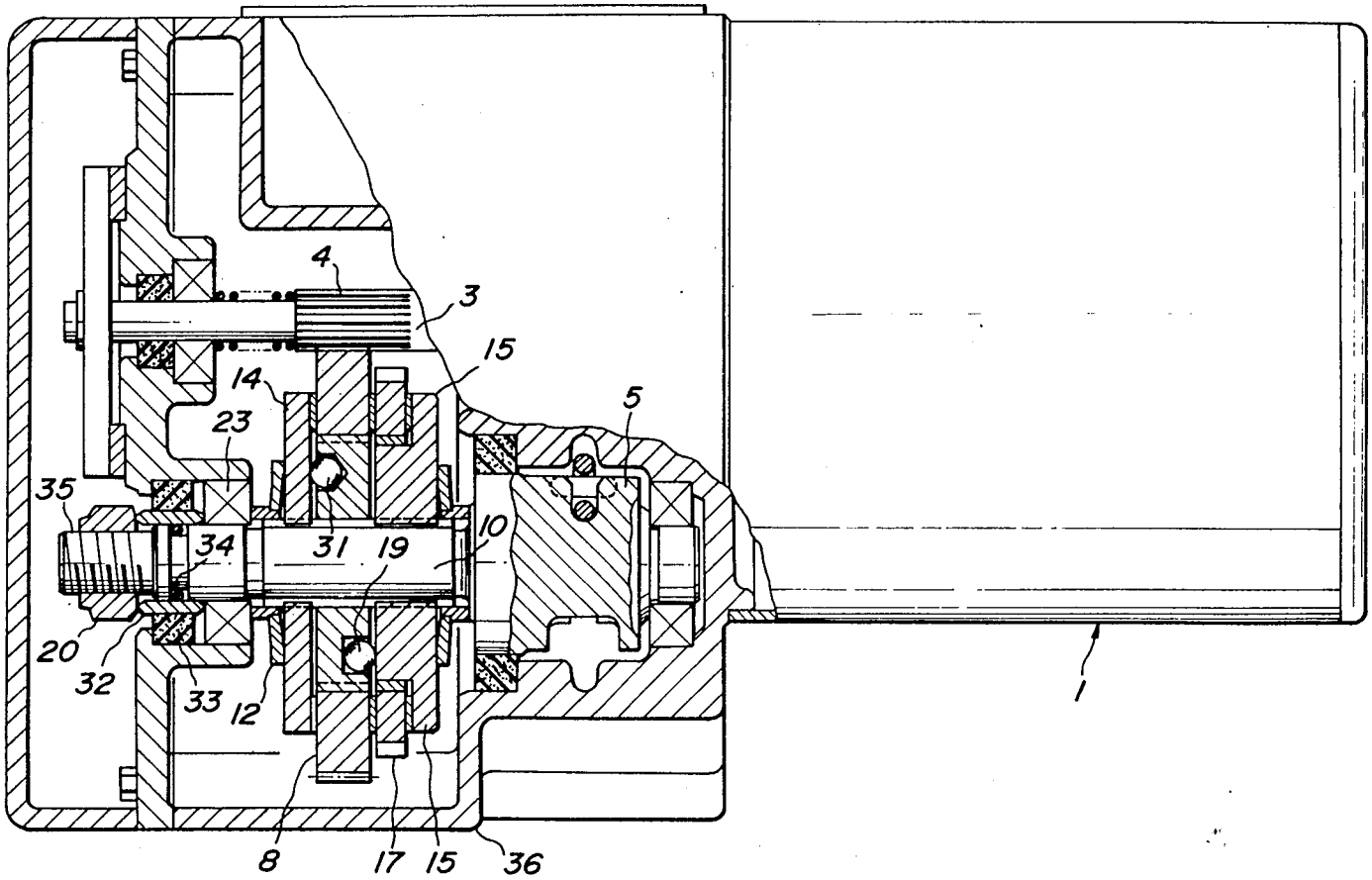
FIG. 7 is a sectional view of a gear transmission mechanism having a torque limiter used in an electric chain block of a third embodiment of the invention.

FIG. 7 illustrates a third embodiment of the invention, whose chain block is substantially similar to that of the first embodiment with exception that an intermediate shaft 10 is formed integrally with a load sheave 5 to eliminate the hollow driven shaft 6, the driven gear 7 and the intermediate driving gear 9.

In carrying out the invention, either of the support member 11 and the urging member 12 may be formed by a dish-shaped spring made of a spring steel. The retainer disc 14 may be arranged between the support member 11 and the interediate driven gear 8 having the cam support 13 thereinside. The brake receiving disc 15 and the ratchet wheel 17 may be arranged between the intermediate driven gear 8 and the urging member 12.

Instead of the steel balls as brake releasing cam member 19, wedge-shaped shoes having oblique surfaces matching the inclined bottom surfaces of the cam grooves 18 may be used. Springs other than the dish-shaped springs may be used as the support member 11 and the urging member 12.

As can be seen from the above explanation, the electric chain block according to the invention comprises an intermediate shaft 10 arranged in parallel with a driving shaft 3, a cam support 13 provided inside an intermediate driven gear 8, a retainer disc 14 and brake receiving disc 15 fitted with a ratchet wheel 17 fitted on the intermediate shaft 10 between the support member 11 anchored to the intermediate shaft 10 and the urging member 12 fitted on the shaft 10, at least one of the members 11 and 12 being a spring, and brake releasing cam members 19 located in cam grooves 18 provided in the cam support 13. This construction of the chain block simplifies the reduction gear mechanism having a torque limiter and a mechanical brake assembly for the electric chain block and makes it easy to manufacture the chain block. Moreover, there is provided an adjusting nut 20 threadedly fitted on the extending end of the intermediate shaft 10 for adjusting the urging force of the urging member 12. Thus the transmission torque of the torque limiter can be easily adjusted by rotating the adjusting nut 20 out of the gear box after the reduction gear mechanism having the torque limiter and the mechanical brake assembly has been assembled.

While the invention has been particularly shown and described with reference to preferred embodiments thereof, it will be understood by those skilled in the art that the foregoing and other changes in form and details can be made therein without departing from the spirit and scope of the invention.

What is claimed is:

1. An electric chain block including a driving shaft connected to a rotating shaft of an electric motor, and a driving gear provided on the driving shaft, and further including an intermediate driven gear in mesh with said driving gear, a torque limiter, and a mechanical brake assembly between the driving shaft and a load sheave, said mechanical brake assembly comprising: an intermediate shaft arranged in parallel with said driving shaft, urging means coupled to the intermediate shaft, a cam support provided radially inside said intermediate driven gear and fitted on said intermediate shaft, a retainer disc and a brake receiving disc axially slidably but non-rotatably mounted on said intermediate shaft respectively on one side and the other side of the cam support, said urging means being a spring, a ratchet wheel for braking interposed between the intermediate driven gear and the brake receiving disc and engaging a pawl for braking, brake releasing cam members accommodated in cam grooves formed in a side of said cam support, the depths of said cam grooves changing circumferentially of the intermediate shaft, and an adjusting nut threadedly engaging an extending end of said intermediate shaft for adjusting the urging force of said urging means.

2. An electric chain block as set forth in claim 1, wherein said urging means is a dish-shaped spring.

3. An electric chain block as set forth in claim 2, wherein said dish-shaped spring is fitted on said intermediate shaft.

4. An electric chain block as set forth in claim 1, wherein said cam support is formed in the other side with a plurality of recesses circumferentially spaced apart from each other in a circle concentric to said intermediate shaft for receiving steel balls.

5. An electric chain block as set forth in claim 1, wherein said cam support is formed integrally with said intermediate driven gear.

6. An electric chain block as set forth in claim 1, wherein said load sheave is formed integrally with said intermediate shaft.

7. An electric chain block as set forth in claim 1, wherein said urging means comprises a support member anchored to said intermediate shaft.

* * * * *